US005222735A

United States Patent [19]

Savage

[11] Patent Number: 5,222,735

[45] Date of Patent: Jun. 29, 1993

[54] SLAPBALL HOCKEY GAME

[76] Inventor: Louis E. Savage, 220 Bayview Ave., Massapequa, N.Y. 11758

[21] Appl. No.: 823,135

[22] Filed: Jan. 21, 1992

[51] Int. Cl.[5] ..... A63F 7/06

[52] U.S. Cl. ..... 273/85 A; 273/85 F

[58] Field of Search ..... 273/85 R, 85 A, 85 B, 273/85 E, 85 F, 119 R, 119 A, 126 R, 129 V, 129 W, 129 R, 129 T, 126 A, 108; D21/7-11, 16

[56] References Cited

U.S. PATENT DOCUMENTS

| | | | |
|---|---|---|---|
| 1,712,159 | 5/1929 | O'Donnell | 273/85 R |
| 2,048,944 | 7/1936 | Munro et al. | 273/85 A |
| 2,237,486 | 4/1941 | Henderson | 273/85 A |
| 2,382,328 | 8/1945 | Munro | 273/85 A |
| 2,382,329 | 8/1945 | Munro | 273/129 |
| 2,655,379 | 10/1953 | Miller | 273/129 R |
| 3,642,280 | 2/1972 | Llorens | 273/85 CX |
| 3,810,622 | 5/1974 | Payne | 273/85 A |
| 3,815,911 | 6/1974 | Cooper | 273/108 X |
| 3,817,523 | 6/1974 | Nolte | 273/85 A |
| 3,995,859 | 12/1976 | Goldfarb et al. | 273/85 B |
| 4,042,239 | 8/1977 | Cecchetti | 273/85 F |

FOREIGN PATENT DOCUMENTS

| | | | |
|---|---|---|---|
| 454453 | 2/1949 | Canada | 273/85 A |
| 632798 | 12/1961 | Canada | 273/85 B |
| 501557 | 6/1930 | Fed. Rep. of Germany | 273/85 F |
| 729694 | 7/1932 | France | 273/85 F |
| 793222 | 1/1936 | France | 273/85 A |
| 768135 | 2/1957 | United Kingdom | 273/85 A |

*Primary Examiner*—V. Millin
*Assistant Examiner*—Sebastiano Passaniti
*Attorney, Agent, or Firm*—Schmeiser, Morelle & Watts

[57] ABSTRACT

An interactive board game featuring a topologically unique playing surface with separate actuation for board playing elements and a goalie position. Formed in the shape of a hockey rink, the board is topologically unique in that it is transversely bisected at its center and descends from the bisection toward the rink ends which contain collection/goal ports. Sporadically actuable striker units are used to impel an object of play over the board surface toward the goals. The object of play may be diverted by either of two diverter units positioned against the rink laterals and may be intercepted and further propelled into play by operation of the goalie which is separately actuable by a game operator or an associate/alternate game operator, the operator and associate located at each end of the board. A spring-biased spider connector arrangement is used to effect sporadic arcuate motion of the striker units by a game operator.

4 Claims, 2 Drawing Sheets

SLAPBALL HOCKEY GAME

BACKGROUND OF THE INVENTION

Field Of The Invention

This invention relates, generally, to a competitive and interactive board game using an object of play, generally a ball. In particular, this invention provides a game for two or more competitive players who both move, and oppose movement of, an object of play over a topologically unique playing surface. Readers generally familiar with pinball devices, table hockey and similar table or board games will recognize a few of the incidents of those games.

Discussion Of Relevant Art

Practically all of the relevant art, i.e., such as bears any resemblance to, or similarity with, the instant invention is quite prevalent and recognized readily by those who posses only passing familiarity with the genre. Three games spring to mind and need little in the way of introduction or description: two board games, namely pinball and table hockey; and, of course, the sports of ice hockey and field hockey.

Pinball is properly a table game in which a generally rectangular table has a sloped surface. Thereon, several diversionary devices emulate channels of travel through which a player (operator) impels a steel, or otherwise heavy, ball. The ball may be sporadically struck by pivotal, cantilevered arms which are activated by the operator, causing the ball to be further diverted from its then current path. Absent any impulsive activity initiated by the operator, or caused by contact with bumper-reactor posts, the ball ultimately coasts down the sloped surface to a catch or collection area, which removes the ball from play. The game of pinball is generally a single player/operator game, but could reasonably be altered to entertain a second player. However, the principal incidents of the activity, the impelled ball reaching the zenith of its trajectory, its retrograde motion down an essentially constant and unidirectional slope and the general area of ball collection (at the operator's end of the table) seems to compel the notion of solitary player operation quite unequivocally.

Contrariwise, table hockey (commonly termed "foosball") is an interactive game wherein one player literally "faces off" against another. By "interactivity" I mean that a player interacts with (by exerting control) the direction and motivation of a gamepiece so as to not only achieve a desired goal but interfere with and frustrate the opponent from doing the same. Interactivity grants to a merely competitive game the highest and noblest state of entertainment by allowing players to combine tactical with psychomotor skills. Indeed, for example, the inveterate "foosball" player often employs custom-made player's sticks so as to always have the same "feel" and strike response when playing. The object of table hockey is for one of at least two players to set an object of play in motion by striking it with the kicker/lever which depends from the stick. The stick may not only be rotated in the bushings by which it is secured transverse the generally rectangular flat table, but it may be shuttled transversely through the bushings. Thus, the striking "player" may effect a side-to-side motion, as well as an arcuate or angular sweep, to not only impel the playing object but to intercept and repel it. It is this action that most closely resembles the pinball "slapper", save for the generally horizontal table/playing surface and the plane of sweep or "slap". As far as the game itself, one imitative of soccer or hockey, the correspondence is quite close. However, unlike cases of the real counterparts of these board or table games, unilateral activity by a discrete board "player" (here I refer to the "goalie") is not contemplated. Neither is there any digression, for whatever reason, from the concept of an essentially rectangular or oval, flat and unrelieved surface.

Finally, in the sport of ice hockey, or its ground analogue field hockey, the salient incidents are not much unlike the aforementioned board game. Of course, in ice hockey, field hockey or the similar soccer, the goalie not only defends the goal but is capable of intercepting the ball (or puck) and taking offensive action. In ice hockey, because of the continuous, elevated barrier around the field periphery (the rink), and the clear space behind the goals between goal screens and the rink wall, the puck remains in play and thus, offensive/defensive action continues even behind the goal.

Hockey and its board game emulators share several incidents or characteristics. The fields or boards are of similar shape and are all perfectly flat or unrelieved. There are no barriers or diversionary elements of any type save goal posts (or screens) and rink (or table) walls. Play generally contemplates various members of the teams being in various states of motion or (even) completely static.

SUMMARY OF THE INVENTION

With my present invention, I have more closely emulated the game of ice hockey but have taken considerably liberties with the use of adjunct mechanism or design wherein I have changed the topology of the board (game) surface, required most of the game "players" to be in motion simultaneously and provided a unique game "player", i.e., the goalie, that very closely emulates the goalie of the real ice hockey game, by giving a gamester (a game operator) the opportunity to not only defend the goal, but to take offensive action by placing the object of play back onto the game surface with varying degrees of impulsion and direction being imparted to the playing object.

In the first of my improvements, I have purposely altered the topology of the game surface, which is termed hereinafter the "rink". Its shape, of course, remains that of the standard ice hockey rink which is generally rectangular with curved ends and differs from the soccer playing field only in that it appears to have arcuate "corners". Unlike any of the true game surfaces (the fields or ice rink), my game surface is not flat and generally unrelieved. Indeed, in order to make the game more challenging, I have transversely bisected the game rink at its nominal center and declined the ends of the rink toward a singular goal which is generally found proximate an ends thereof. The rink is, as customarily seen, surrounded by a confining wall; and the two goals are individually disposed proximate either end of the rink but centrally forward of the respective end walls. The goals also serve as the collection ports for removing the object of play from the game board. Colocated with collection means of the goals, and disposed in a slotted aperture, is a combination handle-bracket which has a portion thereof, the handle, projecting outside the rink for grasping by a game operator and a cup-shaped bracket extension which projects through the collection aperture (port) of the goal and presents its cup shape outwards of the goal. This cup-shaped bracket extension serves as the game "catch" which emulates one of the functional capabilities of a goalie. The handle-bracket catch is also spring biased so that the game operator has some assistance in ejecting the playing object after a catch or "save" is made. Because of the handle-bracket disposition in a slotted aperture, the game operator has considerable degree of control over the azimuth of ejection (or properly, "projection") of the playing object.

Two more unique characteristics of my invention comprise the disposition of a plurality of game "players" characterized as cantilevered striking arms, and diversionary elements, both being more characteristic of the aforementioned pinball device. They are lever actuated by the operator through a special mechanism which acquires a sporadic "slapping" motion to strike the playing object. The striker or slapper units, comprising six for each "team", are disposed four on a team's half of the rink and two straddling the goal which is located across the bisectional division, at the opposite end of the rink. The goal straddling units are considered "offensive" game players because they are worked in unison with the four near-field players to keep the playing object in motion and directed toward the goal that is opposite the game operator position. Finally, there is a diversionary piece, an arcuate wedge-shaped piece disposed on an inner periphery of the rink and which is used to deflect the object of play that is moving "down-rink", generally toward the intended goal of the game operator. The goal side of the diverter is arcuate, so that a playing object moving "up-rink" will be arcuately deflected back toward the intended goal, and is a simple oblique plane on the "up-field" side so as to cause a playing object moving "down-field" to careen off the wall and toward the desired goal. Once the object of play heads toward a goal, only the goalie game "player", as actuated by a defending operator, may be used to deflect, catch and otherwise keep the playing object in play.

The likelihood exists that a playing object could be stalled or "frozen" behind a goal. As an alternative to the topological design of my board, I have added, behind each of the goals, a convexing of the base surface which forces, in the absence of any impulsion to the playing object, a gravity descent of the object toward one of the striker units straddling the goal. Once contact is made with one of the striker units, the playing object will have sufficient impetus to move arcuately around the rink and toward the "up-field" section or into the arcuate portion of the diversionary device.

DETAILED DESCRIPTION OF THE PREFERRED EMBODIMENT

Figure 1:
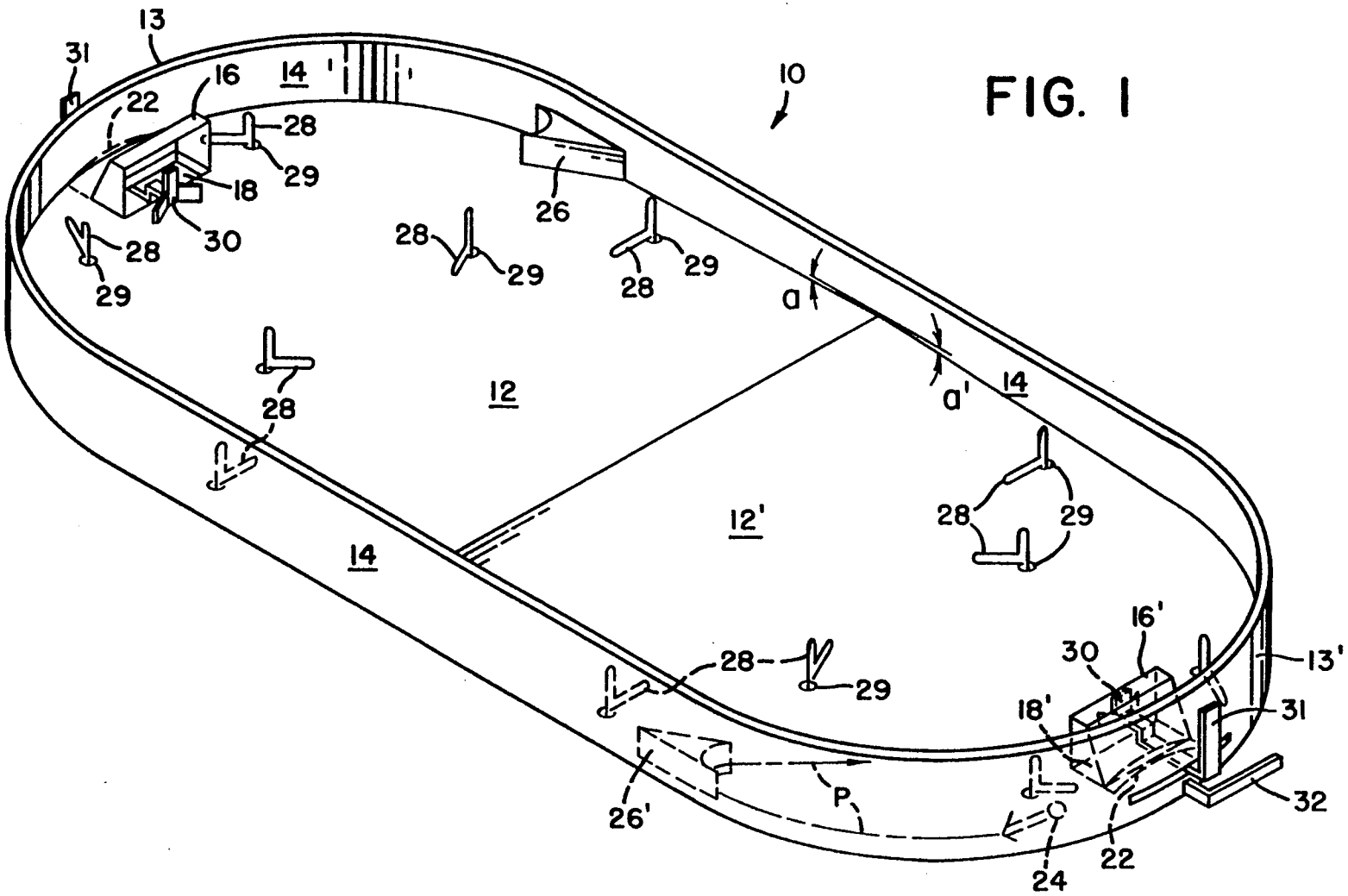
FIG. 1 is an isometric illustration of the invention game board as seen from above, slightly behind and to the left of a goal.

Referring specifically now to FIG. 1, the invention 10 is displayed in isometric illustration depicting the salient portions of the board 12, 12' having a general rectangular shape with arcuate ends 13, 13' and a surround which is termed the rink wall 14. Clearly depicted at each end and covered by the goal screens (indicated 16, 16') are the collection ports 18, 18'. These ports are characterized as slotted apertures in the game board 12, 12'. Referring to the unique topology of the board, the declining ends of the board 12, 12' are readily discerned as they decline at angles a, a', respectively on each side of the transverse bisection 20 of the game board. At the furthermost goal 16 portion of FIG. 1 (hereinafter referred to as "down-field"), the reader may observe the dashed portion behind the goal 16 that represents the alternative topological convex relief 22 which is used to prevent a playing object 24 from stalling behind the goal, between it and the rink wall 14. At the near end of the illustration, this topological relief is marked 22'. Final, to the static elements of the board, diverter units 26, 26' are seen mounted to the wall 14 to the right of goals 16, 16', respectively. In this preferred arrangement, I choose to use only one diverter piece at each lateral (rink side) and in each half of the board. They are arranged as shown, giving not only a symmetry about the bisecting line 20 but also a diagonal (or cross-) symmetry thereabout.

Still referring to FIG. 1, three types of dynamic elements of my invention are the twelve slapper or striker units 28 (six for each "team"). They are set in bushings 29 which project through the board 12, 12'. Clearly depicted in the up-field end (near side) is the handle 31, and a catch on a bracket 30 of a handle-bracket (pair) that extends from outside the rink wall 14 under the board 12, 12' and up through collection ports (slotted apertures) 18, 18'. The catch 30 may be of various cup-like shapes such as a "V", "U" or any other confining shape desired by the game manufacturer. The remaining dynamic element shown in FIG. 1 is the striker arm 28 actuator lever 32. Its design and function shall be described more clearly hereinafter. Finally, there is depicted (in phantom) a probable path of the playing object 24 (preferably a heavy ball) as it is motivated from behind a goal 16' by a slapper 28' and takes a path P as therein depicted: conforming to the arcuate wall 14, into the arcuate portion of a diverter unit 26' and thence toward the goal 16'. Those of ordinary skill may readily infer that were the same playing object 24 to be moving "up-field" along the lateral wall, it would encounter the planar side of diverter unit 26' and be deflected thence toward the goal 16'.

Figure 2:
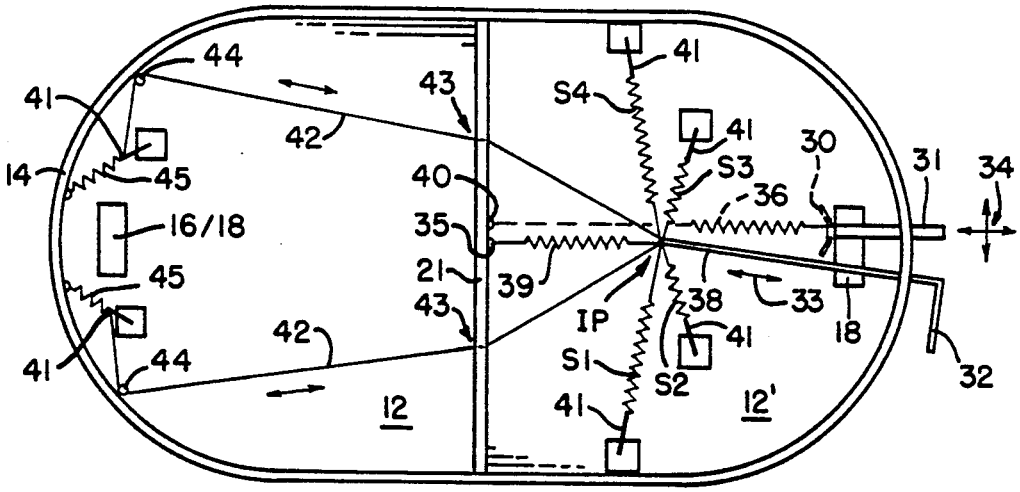
FIG. 2 is a bottom plan layout with a schematic of the control mechanism for but one side of the board.

Because operation of the instant invention contemplates interactivity between at least two game operators (the game may be played with four operators, two each manning a goalie handle-bracket 30, 31 and two each manning striker unit 28 actuation levers 32), it is readily apparent that one side of the board is elementally and functionally identical to the other side. Because of this mirror imagery about the bisector 20, the next figure to be discussed, FIG. 2, will entertain only the mechanism and its explanatory schematic for the right side of the board, it being readily understood that the left side is a mirror image thereof. More particularly concerning FIG. 2, the bottom of the board 12, 12' is displayed showing the schematic of what I term the "mechanism"

for operating the striker units 28 and (in phantom) the goalie handle-brackets 30, 31. As mentioned above, the striker mechanism is actuable, from outside the rink, by lever 32. The striker lever 32 is moveable only in the directions shown by the arrows 33; while the goalie lever 31, carrying with it catch bracket 30, is moveable omni-directionally (to varying degree) as depicted by crossed arrows 34.

Reference now being had to the discrete actuation mechanisms, there is first discussed the spring 36 biasing of bracket 30 to a bisector framework 21 at or proximate point 35 as depicted. Secondly, the mechanism coupled by connector rod 38 of lever 32-connector rod 38 joins a spring biasing spider network at an initial point "IP". The IP is spring 39-biased to frame 21 at point 40. Additionally, the IP is connected through springs S1, S2, S3 and S4 to underside striker 28 subtended arms 41 in a "spider" array. Thus, it may be readily seen that lever 32 may be drawn back in the direction shown by the right hand portion of arrow 33, causing the IP to traverse in that direction and carry with it the various subtended arm 41 portions of strikers 28. Abruptly releasing lever 32 will cause it and the connector 38 (joined at a common point with the spider arrangement), with the aforesaid spider arrangement, to be rebiased by spring 39 to the IP. It may be seen that the IP is, in fact, a common point of connection for wall striker subtended arms 41 and derives the nomenclature "IP" only from the fact that it represents the common point at rest. Concomitant with the movement of the lever 32, tethering wires 42, which pass through the frame 21 through holes 43, connect via eyelets 44 to the subtended arms 41 of the striker pair straddling the goal 16/18 which is located directly opposite the actuating lever 32. The reader should notice that the aforementioned goal straddling striker units are spring biased, not to the IP, but rather to the wall 14 by springs 45. Those of ordinary skill will readily discern that the aforementioned mechanisms are merely illustrative of the manner in which I choose to simultaneously actuate all striker units, employ spring biasing to effect a "player" slapping motion and accomplish separate discrete goalie actuation from that of the remaining board "players" or associate game operators.

Figure 3:
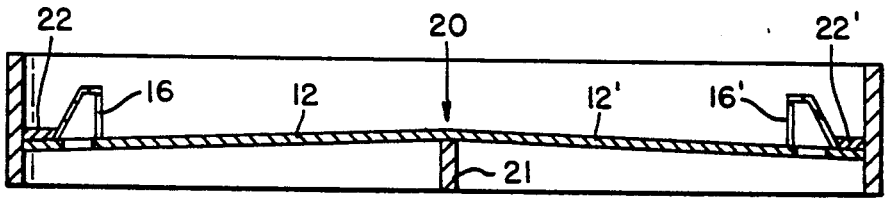
FIG. 3 is a cross sectional side elevation of the game board.
Figure 6:
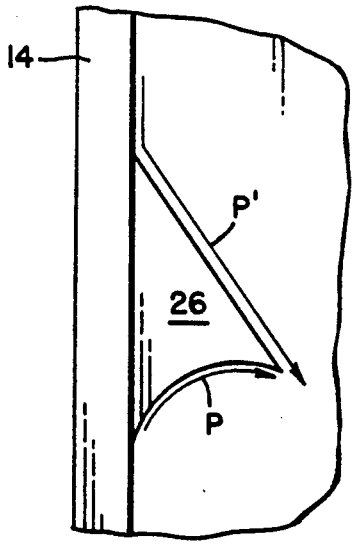
FIG. 6 is a top plan of a diverter unit.

FIG. 3 depicts the salient elements of the board or rink, highlighting, in cross section: the rink wall 14, the bisected and mutually declining surfaces 12, 12', the partition framework 21, goal screens 16, 16' and the optional col or convex surface 22, 22' area between the goal screens and the rink wall. The lower right hand illustration, FIG. 6, is a top plan of a diverter unit 26 as it would appear fixed to a lateral of the board. Arrow P depicts how a playing object might be deflected along the arcuate portion of the deflection unit. If the playing object were moving toward the oblique edge, say from top towards the bottom of FIG. 6, it would be deflected in the direction of arrow P'. This facility was adequately discussed during the exposition of FIG. 1.

Figure 4:
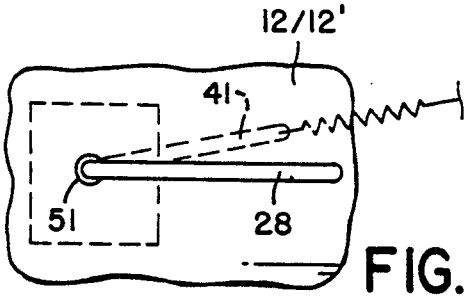
FIG. 4 is a top plan detail of a striker arm.
Figure 5:
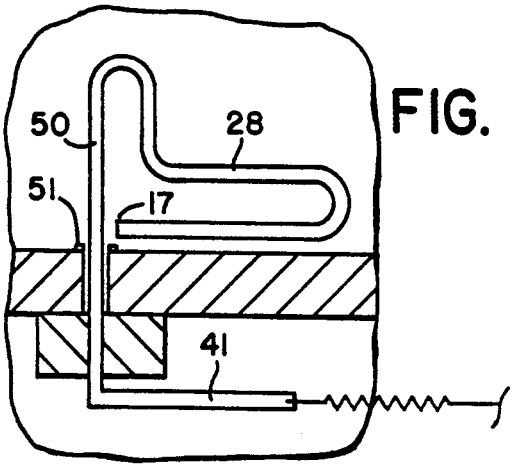
FIG. 5 is a cross sectional side elevation of a striker arm.

The last two illustrations of this description, FIGS. 4 and 5, relate to the slapper or striker assembly which includes a singular cantilevered upper arm 28, connected through a shaft means 50, coupled to and subtending an extension arm 41 which is located below the surface of the playing board 12/12'. I prefer to make this unit out of steel wire, forming it in the shape shown herein and allowing the upper cantilevered 28 wire end 17 to ride on bushing 51 to acquire a smooth, easy pivotation within the bushing. Supporting blocks B are optional and may not be desired by the manufacturer. As shown in FIG. 4, upper arm 28 (the cantilevered striker unit) is bent (offset) the subtended arm extension 41; the characteristics of the steel wire which I have employed herein allows the game operator to use this facility and set the striker arm contacting position to any desired setting by merely holding subtended arm 41 in its normally biased, rest position and twisting the cantilever striker arm 28 on shaft 50. As may be readily inferred herefrom, other arrangements which allow a fixable slippage between the two arms 28 and 41, may be utilized.

Having disclosed the salient elements of my invention, while pointing out possible or alternative apparatus, it may be readily seen that the topological aspects, the independent goalie function and maneuverability and, to some extent, the diverter pieces combine to give a unique apparatus and, consequently, a vast improvement in the method of play as such would relate to a hockey board game of the instant genre. Those familiar with the art, or familiar with the sports which it emulates, will find this game distinctive over those currently in use and such is commended to them for their enjoyment, consistent with the hereinafter appended claims.

What is claimed is:

1. An improved table-hockey game of the type having a substantially rectangular board that includes a playing surface that slopes downwardly toward opposite ends thereof, a wall surrounding the playing surface that functions to retain and direct a movable ball means, two groups of pivotable slapper members wherein each group comprises a plurality of slapper members that are located on the playing surface in a spaced relation to each other and which are interconnected and that are simultaneously actuated by the movement of a handle member located at the periphery of the board, a first goal means located proximate one end of the board and a second goal means located proximate an opposite end of the board, the improvement comprising:

first and second movable goalies wherein each of said goalies is located forwardly of an associated one of said goal means, said goalies each having a forward portion facing an opposite end of the board and functioning to releasably catch the board means;

first and second handle members, wherein each of said handle members is located proximate an opposite end of said board and is attached to an associated one of said goalies by a connecting means wherein by moving one of said handle members, a user can move an associated goalie toward or away from the goal means and also in a side to side motion; and a first and second spring means each operatively connected to an associated one of said goalies, wherein the spring means biases the associated goalie toward a forward position whereby when a user pulls back on a handle member attached to a goalie, the spring means is stretched so that if the user releases the handle member when the spring means is in a stretched condition, the spring means will snap back to its un-stretched state thereby propelling the associated goalie in a forward direction thereby enabling a user to cause a goalie that has a ball means located within the goalie's generally U-shaped forward portion to forcefully eject the ball means from the goalie with the aid of the spring means.

2. The game of claim 1 wherein each of the spring means has a longitudinal axis and is operatively attached to the board in a manner wherein when a user pulls a goalie to a rearward position, the associated spring means will apply a forward force on the goalie in the direction of the longitudinal axis of the spring means wherein when a ball means is to be ejected from a goalie, it will be ejected along a linear path substantially parallel to said direction of the longitudinal axis of the spring means.

3. The game of claim 1 further comprising first and second diverter means, said first diverter means located forwardly of the first goal means and having a rear surface that is concave in shape and faces the end of the board that is located rearwardly of the first goal means, said second diverter means located forwardly of the second goal means and having a rear surface that is concave in shape and faces the end of the board that is located rearwardly of the second goal means.

4. The game of claim 1 wherein each of said first and second goal means is spaced from an associated end of the playing field and wherein a convexly-shaped playing surface portion is located behind each of said first and said second goal means in a position between a rear portion of the goal means and the retaining wall located at the associated end of the playing surface.

* * * * *